US008303345B2

(12) United States Patent
Tan

(10) Patent No.: US 8,303,345 B2
(45) Date of Patent: Nov. 6, 2012

(54) ELECTRICAL CONNECTOR FOR RESTRICTING CONTACTS REVERSED

(75) Inventor: Wei Tan, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 66 days.

(21) Appl. No.: 13/041,426

(22) Filed: Mar. 6, 2011

(65) Prior Publication Data

US 2011/0306245 A1 Dec. 15, 2011

(30) Foreign Application Priority Data

Jun. 10, 2010 (CN) ..... 2010 20221932

(51) Int. Cl.
*H01R 24/00* (2006.01)

(52) U.S. Cl. ..... 439/626

(58) Field of Classification Search ..... 439/626, 439/840

See application file for complete search history.

(56) References Cited

U.S. PATENT DOCUMENTS

| | | | | |
|---|---|---|---|---|
| 3,955,875 | A * | 5/1976 | Petiot | 439/631 |
| 2012/0045940 | A1 * | 2/2012 | Bodmann et al. | 439/626 |
| 2012/0052733 | A1 * | 3/2012 | Zhu | 439/626 |

* cited by examiner

*Primary Examiner* — Renee S Luebke
*Assistant Examiner* — Larisa Tsukerman
(74) *Attorney, Agent, or Firm* — Wei Te Chung; Ming Chieh Chang

(57) ABSTRACT

An electrical connector includes an insulative housing and a plurality of contacts secured in the insulative housing. The insulative housing defines a mating face and a plurality of receiving passageways running through the mating face for receiving the contacts and arranged along a first direction thereof. Each contact defines a contacting portion protruding out of the receiving passageway from the mating face. The electrical connector further includes a baffled stick assembled in the mating face and across the receiving passageways along the first direction of the insulating housing.

8 Claims, 5 Drawing Sheets

ELECTRICAL CONNECTOR FOR RESTRICTING CONTACTS REVERSED

BACKGROUND OF THE INVENTION

1. Field of the Invention

The present invention generally relates to an electrical connector, and more particularly, to a novel structure of an electrical connector with a baffled stick for restricting reverse of contacts.

2. Description of Related Art

An electrical connector includes an insulative housing and a plurality of contacts secured in receiving passageways of the insulative housing in a direction from down to up. Each contact defines a contacting portion protruding from a mating face of the insulative housing, an elastic portion receiving in the receiving passageway and connecting with the contacting portion and a retention portion retained in the receiving passageway and extending from the elastic portion. In a process of the electrical connector mating with a complementary connector, a lateral pressing force is exerted on the contacting portions to making the contacting portions move in a direction face to the mating face. The pressing force is also exerted on the elastic portions to make the elastic portions moving rearward. The contact moves downwardly under the pressing force. The contacts may move out of the receiving passageways to result a poor contact of the electrical connector. Thus, an electrical connector with a baffled stick for restricting the contacts reversed is desired to overcome the disadvantages of the related art.

Hence, the present invention is directed to solving this problem in the related art.

SUMMARY OF THE INVENTION

An object of the invention is to provide an electrical connector which has a baffled stick for restricting reverse of contacts therein.

In order to achieve the object set forth, an electrical connector includes an insulative housing and a plurality of contacts secured in the insulative housing. The insulative housing defines a mating face and a plurality of receiving passageways running through the mating face for receiving the contacts and arranged along a first direction thereof. Each contact defines a contacting portion protruding out of the receiving passageway from the mating face. The electrical connector further includes a baffled stick assembled in the mating face and across the receiving passageways along the first direction of the insulating housing.

Other objects, advantages and novel features of the invention will become more apparent from the following detailed description when taken in conjunction with the accompanying drawings.

DETAILED DESCRIPTION OF THE INVENTION

Figure 1:
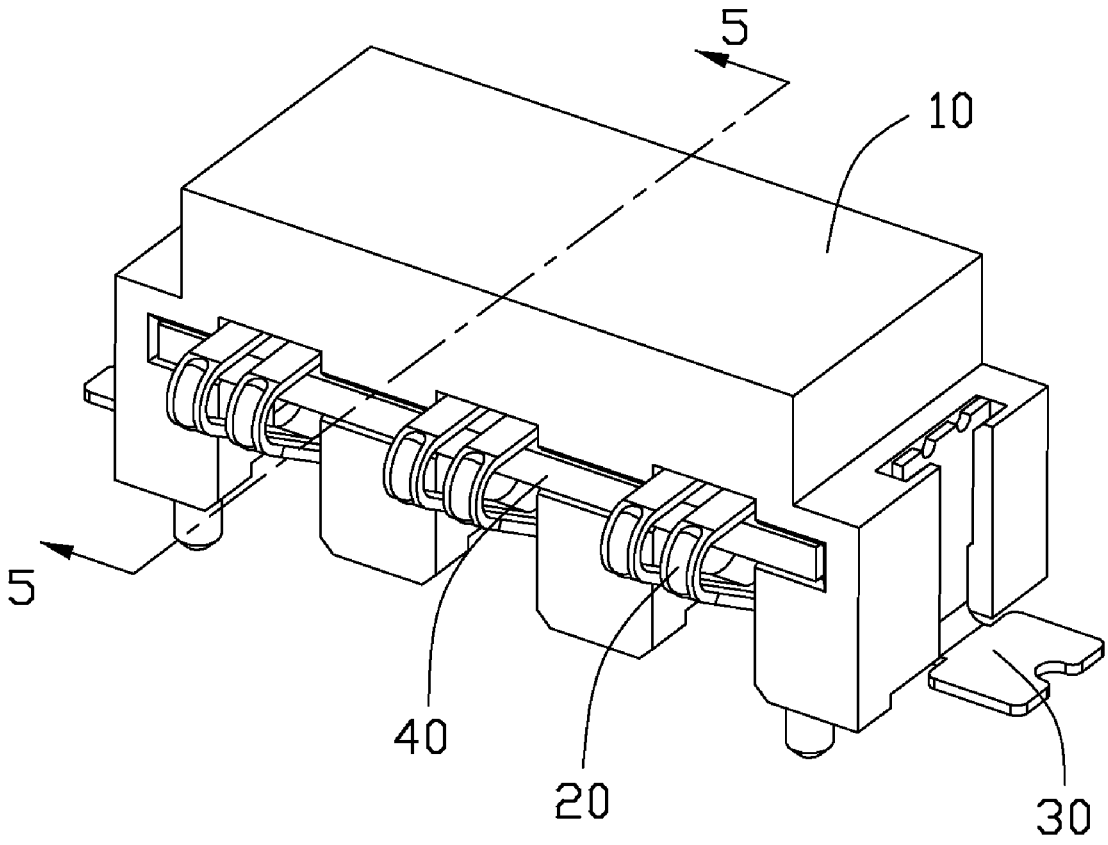
FIG. 1 is a perspective view of an electrical connector of an embodiment of the present invention.
Figure 2:
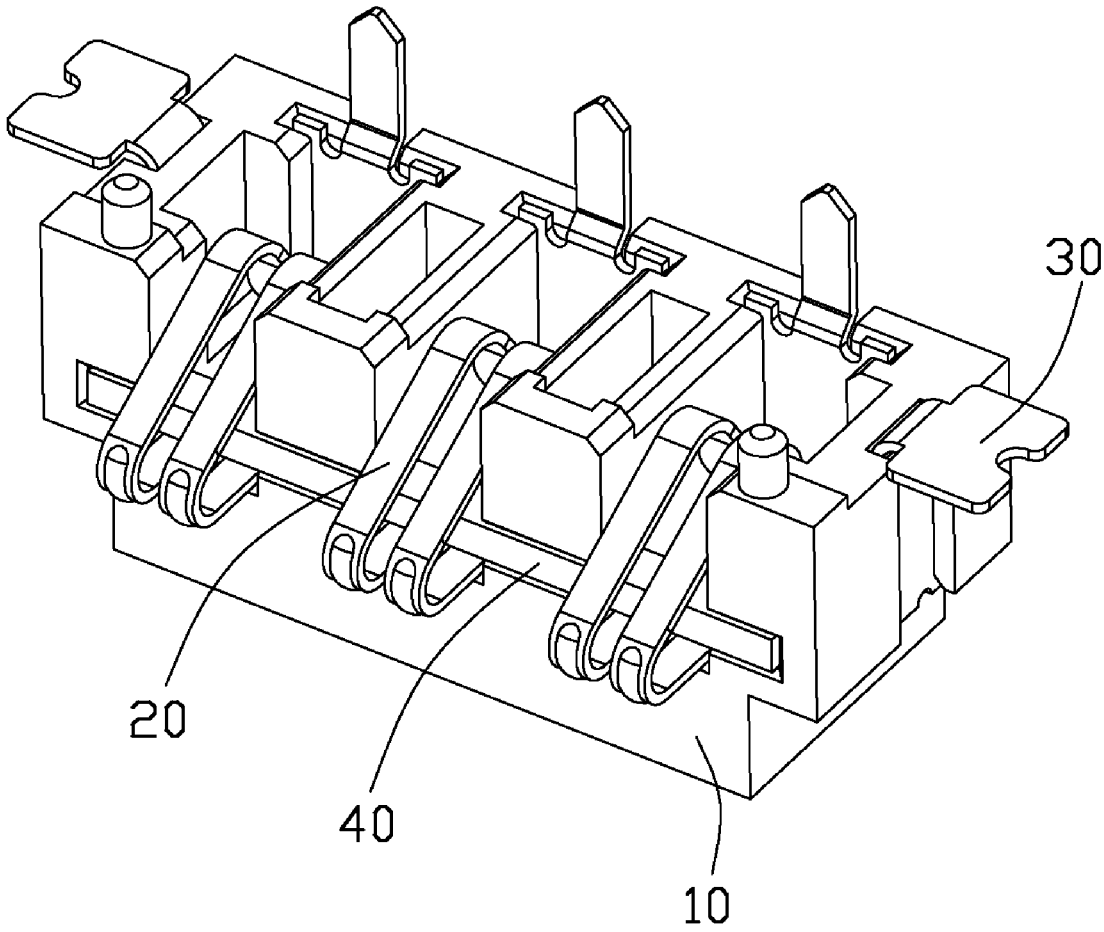
FIG. 2 is a view similar to FIG. 1, while taken from a different aspect.

Reference will now be made in detail to the preferred embodiment of the present invention.

Referring to FIGS. 1-5, an electrical connector 1 in accordance with an embodiment of the present invention comprises an insulative housing 10, a plurality of contacts 20 secured in the insulative housing 10, a pair of soldering pads 30 disposed at two sides of the insulative housing 10 and a baffled stick 40 assembled in the insulative housing 10.

Figure 3:
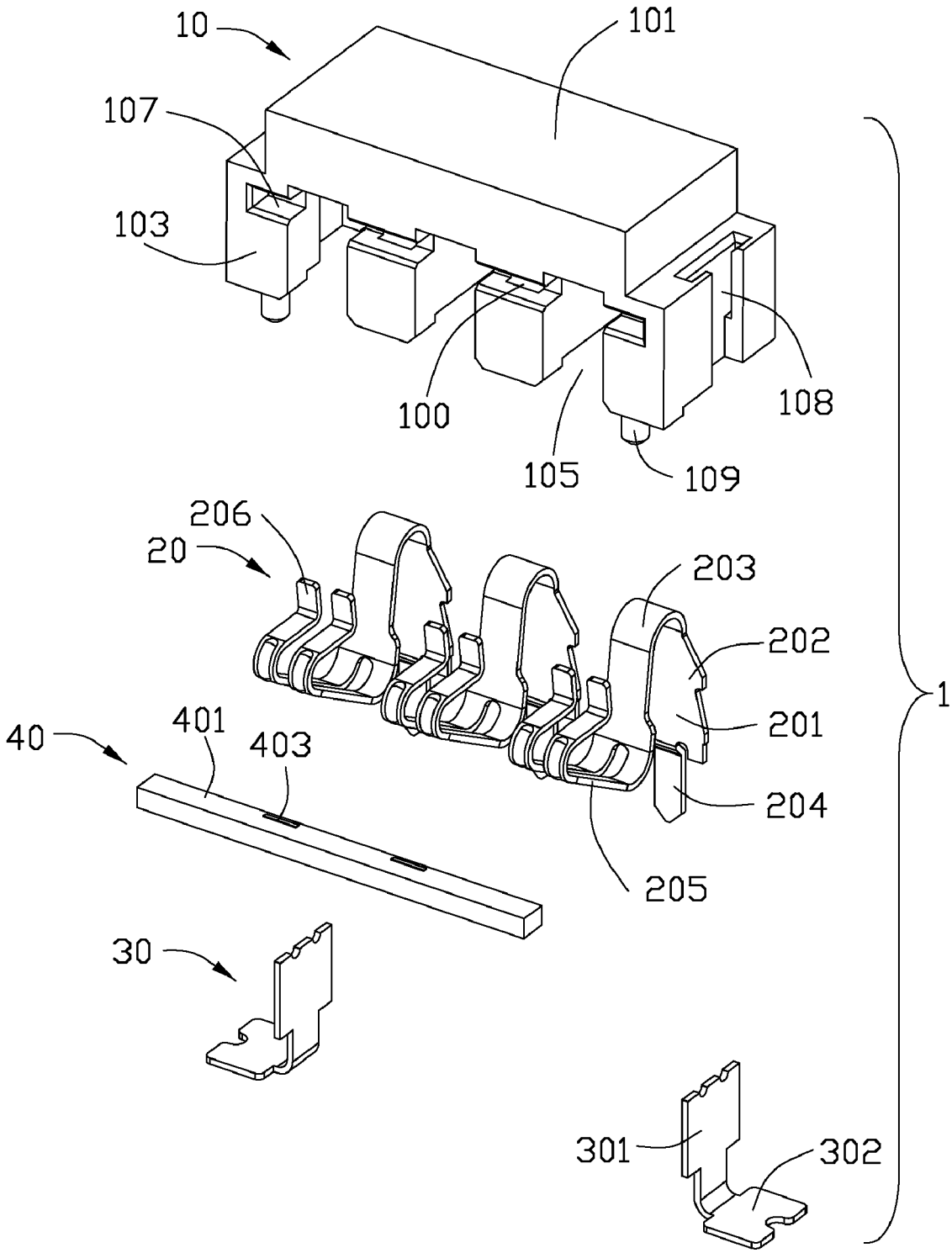
FIG. 3 is an exploded perspective view of the electrical connector as shown in FIG. 1.
Figure 4:
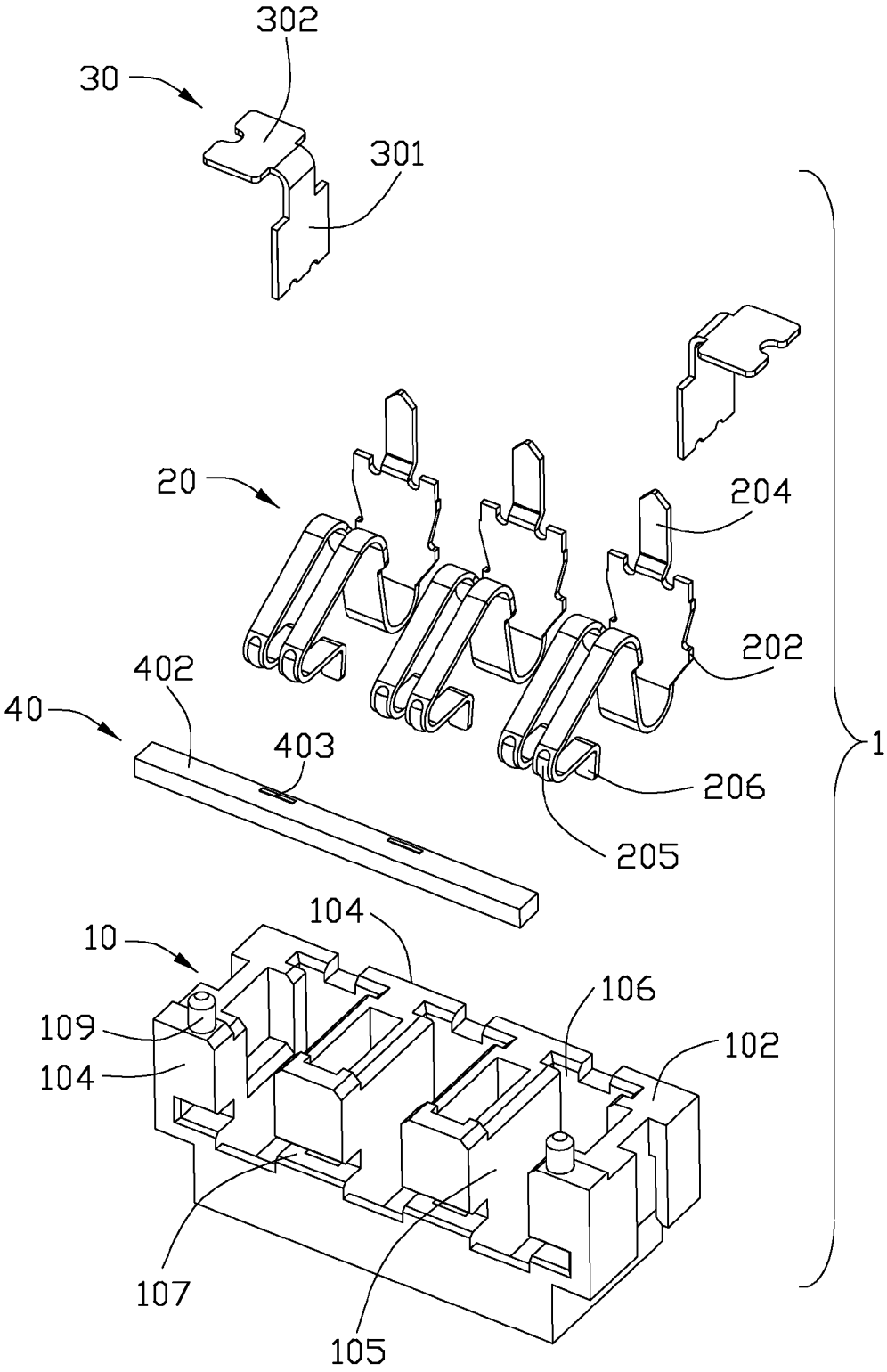
FIG. 4 is an exploded perspective view of the electrical connector as shown in FIG. 2.
Figure 5:
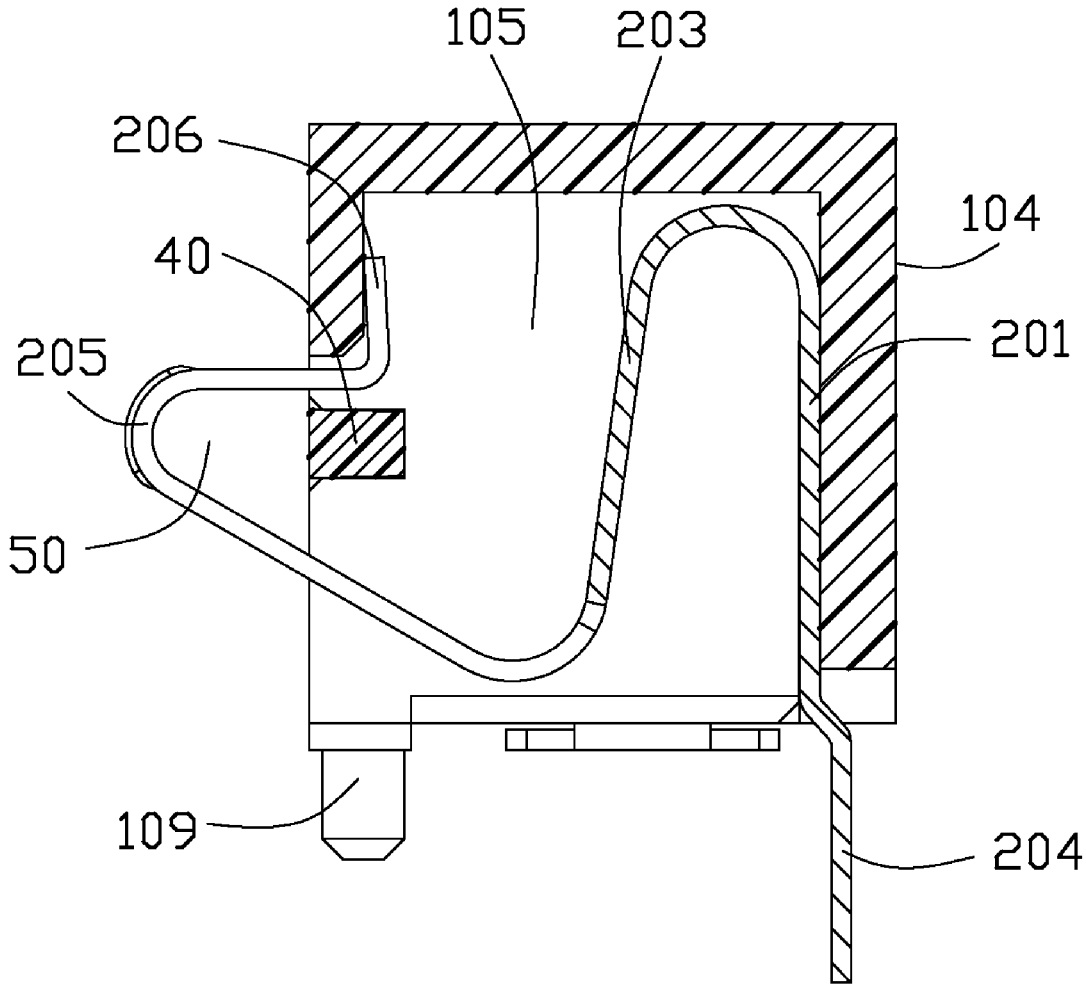
FIG. 5 is a cross section view of the electrical connector of FIG. 1 taken along line 5-5.

Referring to FIGS. 3 and 4, the insulative housing 10 defines a top surface 101, a bottom surface 102 opposite to the top surface 101, a mating surface 103 connecting with the top surface 101 and the bottom surface 102 and a rear surface 104 opposite to the mating surface 103. A plurality of receiving passageways 105 are arranged in a longitudinal direction of the insulative housing 10 and extend through the mating surface 103 and the bottom surface 102 for receiving the contacts 20. The receiving passageway 105 defines a retaining slot 106 adjacent to the rear surface 104 and extending in an up and down direction. The insulative housing 10 further defines a retaining slot 107 recessed from the mating face 103 and extending in the longitudinal direction thereof The retaining slot 107 goes across the plurality of receiving passageways 105 for receiving the baffled stick 40. A pair of mounting slots 108 is defined at two sides of the insulative housing 10 along the longitudinal direction for retaining the pair of soldering pads 30. And a pair of posts 109 is defined on two side ends of the bottom surface 102 along the longitudinal direction. The insulative housing 10 is accurately mounted on a printed circuit board (not shown) by the pair of posts 109 and the pair of soldering pads 30.

Referring to FIGS. 3 and 4, each contact 20 is stamped from a metallic plate and assembled in the insulative housing 10 from down to up. Each contact 20 defines a flat retention portion 201 received in the retaining slot 106 with interferential barb portions 202 at two lateral sides of the retention portion 201 and engaged with the retaining slot 106. An elastic portion 203 bends downwardly from an upper end of the retention portion 201 and is received in the receiving passageway 105. A soldering portion 204 extends downwardly from a lower end of the retention portion 201 and passing through the bottom surface 102 of the insulative housing 10 after the soldering portion 204 is assembled in the insulative housing 10. The soldering portion 204 is mounted to the printed circuit board. A pair of contacting portions 205 is defined at a distal end of the elastic portion 203 and protrudes out of the receiving passageway 105 from the mating surface 103. The pair of contacting portions is spaced and parallel to each other. The contact 20 defines a restricting portion 206 extending from a distal end of the contacting portion 205 and pressing against an inner face of the receiving passageway 105 to provide a pre-compression for the contacting portions 205 of the contacts 20.

Referring to FIGS. 1 and 3, the pair of soldering pads 30 is assembled in the mounting slots 108 at the two sides of the insulative housing 10 from down to up. Each soldering pad 30 defines an up-standing portion 301 interferential with the mounting slot 108 and a horizontal portion 302 perpendicular to the up-standing portion 301 and used to be sealed on the printed circuit board.

Referring to FIGS. 1-5, the baffled stick 40 is a lathy rectangle and assembled on the mating surface 103. The baffled stick 40 defines a top face 401 and a bottom face 402 opposite to the top face 401. A plurality of engaging sections 403 are respectively defined on the top face 401 and the bottom face 402 for retaining the baffled stick 40 in the retaining slot 107. The retaining slot 107 defines a plurality of retaining slits 100 corresponding to receive the engaging sections 403. An inserting room 50 is defined among the part of the contacting portions 205 protruding out of the receiving passageways 105 and the mating surface 103 (refer to FIG. 5). First, the baffled stick is inserted into the inserting room 50 in the longitudinal direction and passes through the contacting portions 205 of the contacts 20. Second, the baffled stick is assembled in the retaining slot 107 from the mating surface 103 in a lateral direction. Finally, the engaging portions 403 of the baffled stick 40 are secured into the retaining slits 100 of the retaining slot 107. The baffled stick is coplanar with the mating surface. The baffled stick 40 extends in the longitudinal direction perpendicular to a direction in which the contacting portions 205 of the contacts 20 move. The baffled stick 40 is located between the contacting portions 205 and the elastic portions 203. When the electrical connector 1 mates with a complementary connector (not shown), a pressing force is exerted on the contacting portions 205 of the contacts 20, and then the contacting portions 205 move into the receiving passageways 105 of the insulative housing 10. The contacts 20 are also possible to move downwardly under the pressing force. The baffled stick 40 prevents the contacts from moving out of the receiving passageways 105 and improves an electrical connecting performance of the electrical connector 1.

The present invention will now be described in detail with reference to a preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

What is claimed is:

1. An electrical connector comprising:

an insulative housing defining a mating surface and a plurality of receiving passageways running through the mating surface and arranged along a first direction thereof;

a plurality of contacts secured in the receiving passageways of the insulative housing, each contact defining a contacting portion protruding out of the receiving passageway from the mating surface;

a baffled stick assembled in the mating surface and across the receiving passageways along the first direction of the insulating housing; wherein the contacting portions of the contacts move in a second direction perpendicular to the mating surface; the insulative housing defines a retaining slot recessed from the mating surface and extending in the first direction thereof; and wherein an inserting room is defined among the contacting portions and the mating surface of the insulative housing, the baffled stick is inserted into the inserting room in the first direction and then moved to be retained in the retaining slot.

2. The electrical connector as claimed in claim 1, wherein the baffled stick defines engaging sections and the retaining slot defines retaining slits in inside faces thereof to receive the engaging sections so as to fitly assemble the baffled stick in the retaining slot.

3. The electrical connector as claimed in claim 1, wherein each contact defines a retention portion and an elastic portion connecting with the retention portion and the contacting portion, the baffled stick is located between the contacting portions and the elastic portions.

4. The electrical connector as claimed in claim 3, wherein each contact defines a restricting portion extending from the contacting portion and pressing against an inner face of the receiving passageway.

5. An electrical connector comprising:

an insulating housing defining a mating surface, a mounting surface and passageways running through the mating surface and the mounting surface;

contacts assembled and retained in the receiving passageways from the mounting face, the contacts comprising contacting portions protruding forward beyond the mating surface;

a baffled stick assembled to the insulating housing from the mating face and located behind the contacting portions;

wherein each contact defines a retention portion and an elastic portion connecting with the retention portion and the contacting portion, the baffled stick is located between the contacting portions and the elastic portions and each contact defines a restricting portion extending from the contacting portion and pressing against an inner face of the receiving passageway, and wherein the baffled stick is embedded in the mating face.

6. The electrical connector as claimed in claim 5, wherein the baffled stick is coplanar with the mating surface.

7. An electrical connector comprising:

an insulative housing defining a plurality of passageways each having a front opening and a bottom opening to communicate with an exterior;

a plurality of contacts upwardly assembled into the corresponding passageways, respectively, each of the contacts defining a lying V-shaped contacting portion extending beyond a front face of the housing;

a baffled stick assembled to said front face and circumferentially located in an interior space of an configuration defined by said lying V-shaped contacting portion so as to preventing excessive inward deformation of said contacting portion;

wherein the front opening and the bottom opening are configured to allow the contacts to be upwardly inserted into the corresponding passageways, respectively, under condition of removal of said baffled stick away from the housing, and only after the contacts are assembled into the corresponding passageways, said baffled stick is moved along a longitudinal direction to be located between the V-shaped contacting portion and the front mating face, and successively moved rearwardly to be assembled to the front face.

8. The electrical connector as claimed in claim 7, wherein said contacting portion further includes a free end portion downwardly confronting said baffled stick for preventing excessive downwardly deformation of the contacting portion.

* * * * *